US008096703B2

(12) United States Patent
Carrard et al.

(10) Patent No.: US 8,096,703 B2
(45) Date of Patent: Jan. 17, 2012

(54) TIMEPIECE COMPRISING A ROTATING BEZEL

(75) Inventors: Bertrand Carrard, Bassecourt (CH); Clement Meyrat, Le Landeron (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 11/911,363

(22) PCT Filed: Apr. 3, 2006

(86) PCT No.: PCT/EP2006/003012
§ 371 (c)(1),
(2), (4) Date: Oct. 12, 2007

(87) PCT Pub. No.: WO2006/108530
PCT Pub. Date: Oct. 19, 2006

(65) Prior Publication Data

US 2008/0192586 A1 Aug. 14, 2008

(30) Foreign Application Priority Data

Apr. 13, 2005 (EP) ..... 05008106

(51) Int. Cl.
*G04B 37/00* (2006.01)

(52) U.S. Cl. ..... 368/295; 368/294; 368/291

(58) Field of Classification Search ..... 368/295, 368/294, 291
See application file for complete search history.

(56) References Cited

U.S. PATENT DOCUMENTS

| | | | | |
|---|---|---|---|---|
| 4,184,317 | A * | 1/1980 | Kanda et al. | 368/300 |
| 4,346,464 | A * | 8/1982 | Wenger | 368/289 |
| 5,383,166 | A * | 1/1995 | Gallay | 368/288 |
| 5,822,279 | A * | 10/1998 | Cuche et al. | 368/295 |
| 6,200,019 | B1 * | 3/2001 | Latini | 368/289 |
| 2006/0002242 | A1 | 1/2006 | Meier | |

FOREIGN PATENT DOCUMENTS

| | | |
|---|---|---|
| EP | 1420307 | 5/2004 |
| JP | 62-98289 | 5/1987 |
| WO | WO 2004046831 A1 * | 6/2004 |

OTHER PUBLICATIONS

Anonymous, "Solutions for Rotary Applications," Apr. 19, 2004, pp. 1-13.

International Search Report issued in corresponding application No. PCT/EP2006/003012, completed Jul. 14, 2006 and mailed Jul. 25, 2006.

Random House Webster's College Dictionary, pp. 279 and 1265 (1991), filed herewith as Exhibit B.

* cited by examiner

*Primary Examiner* — Renee S Luebke
*Assistant Examiner* — Jason Collins
(74) *Attorney, Agent, or Firm* — Griffin & Szipl, P.C.

(57) ABSTRACT

The invention comprises a timepiece including a middle part (4) and a bezel (6) capable of rotating on the middle part (4), the bezel (6) and the middle part (4) delimiting between them an annular chamber (38) in which there is arranged a sealing gasket (40) with a U-shaped profile. A compression member (42) such as an O-ring type joint with a smooth external surface is housed in the sealing gasket (40).

8 Claims, 2 Drawing Sheets

TIMEPIECE COMPRISING A ROTATING BEZEL

This is a National Phase Application in the United States of International Patent Application No. PCT/EP2006/003012 filed Apr. 3, 2006, which claims priority on European Patent Application No. 05008106.6, filed Apr. 13, 2005. The entire disclosures of the above patent applications are hereby incorporated by reference.

The present invention concerns a timepiece such as, in particular, a wristwatch, including a middle part and a bezel able to rotate on the middle part, a sealing gasket being inserted between the bezel and said middle part.

A watch of the aforementioned type is known from European Patent No. EP 1 420 307 in the name of the Swiss company Eterna. This watch includes a middle part and a bezel mounted to move in rotation on the middle part. The middle part and the bezel define between them an annular chamber and a gap open towards the exterior of the case. A sealing gasket, inserted between the bezel and the middle part, is arranged in the chamber. This gasket includes an annular shaped ring made of a strongly elastically deformable material and the cross-section of which includes two lips, one abutting against the bezel and the other against the middle part. A compression member is arranged in the chamber, on the side of the gap, inserted between and cooperating with the lips to press them respectively against the bezel and against the middle part.

The compression member is formed of an annular spring which takes the form of a strip of substantially constant width forming regular waves arranged on either side of a circle whose diameter is substantially equal to the median diameter of the chamber. The waves are folded in a V shape on either side of the line forming the diameter of the spring. The angle formed by the waves is slightly greater than that formed by the lips such that, when the spring is set in place, it constrains the free ends of the lips against the walls of the chamber. The annular spring is in contact with the lips of the gasket by the tip of the V-shaped folds. It is on these folds that the pressure exerted by the spring on the gasket is strongest. Thus, during the use of the rotating bezel, the folds of the spring bite the sealing gasket and are driven into the material of which the gasket is made, which irremediably alters the sealing qualities of the latter.

The sealing gasket has the overall shape of a U open on the side of the gap, which places the annular chamber in communication with the external environment. When the watch is immersed, the water compresses the gasket and applies the lips against the walls of the chamber. It has been realised that this type of arrangement, wherein the water penetrates the interior of the gasket because the latter is open on the side of the gap, does not provide optimal sealing. Further, all kinds of solid element are able to lodge between the lips of the U-shaped gasket and grip the rotating bezel mechanism.

It is an object of the present invention to overcome the aforementioned problems, in addition to others by providing a timepiece including a rotating bezel the operation of which is, in particular, more reliable.

The present invention therefore concerns a timepiece including a rotating bezel and a middle part, the rotating bezel being able to be driven in rotation relative to the middle part, said bezel and said middle part defining between them an annular chamber that communicates with the exterior via a gap, a sealing gasket with lips having a U-shaped profile being arranged in the chamber so as to make the assembly, formed by the bezel and the middle part, impervious, and a compression member that exerts a compressive effort on the lips via the effect of which said lips are respectively pressed against the bezel and against the middle part, being housed inside the gasket, the timepiece being characterized in that the external surface of the compression member is smooth.

Owing to these features, the present invention provides a compression member whose compression force is no longer transmitted only along the points of contact to the sealing gasket. Thus, the compression member no longer damages the gasket, which guarantees that the latter has a high level of sealing quality for the entire life of the watch.

According to a complementary feature of the invention, the compression member is an O-ring type joint. The compression rate of the sealing gasket can be adapted freely by adjusting the Shore hardness or the cross-section of the O-ring joint.

According to another feature of the invention, the base of the sealing gasket forms an intermediate part connecting the lips of said gasket is located on the side of the gap such that the free lip has a corner effect in the event of excess water pressure. In fact, a gasket with lips is conventionally formed by a steel framework onto which a U-shaped elastomeric part has been moulded. The external part of the gasket forms a seal in the chamber, while the internal part has a lip that comes into contact with the compression member.

Other features and advantages of the present invention will appear more clearly upon reading the following description of an embodiment of the timepiece according to the invention, this example being given purely by way of non-limiting illustration in conjunction with the annexed drawing, in which.

Figure 1:
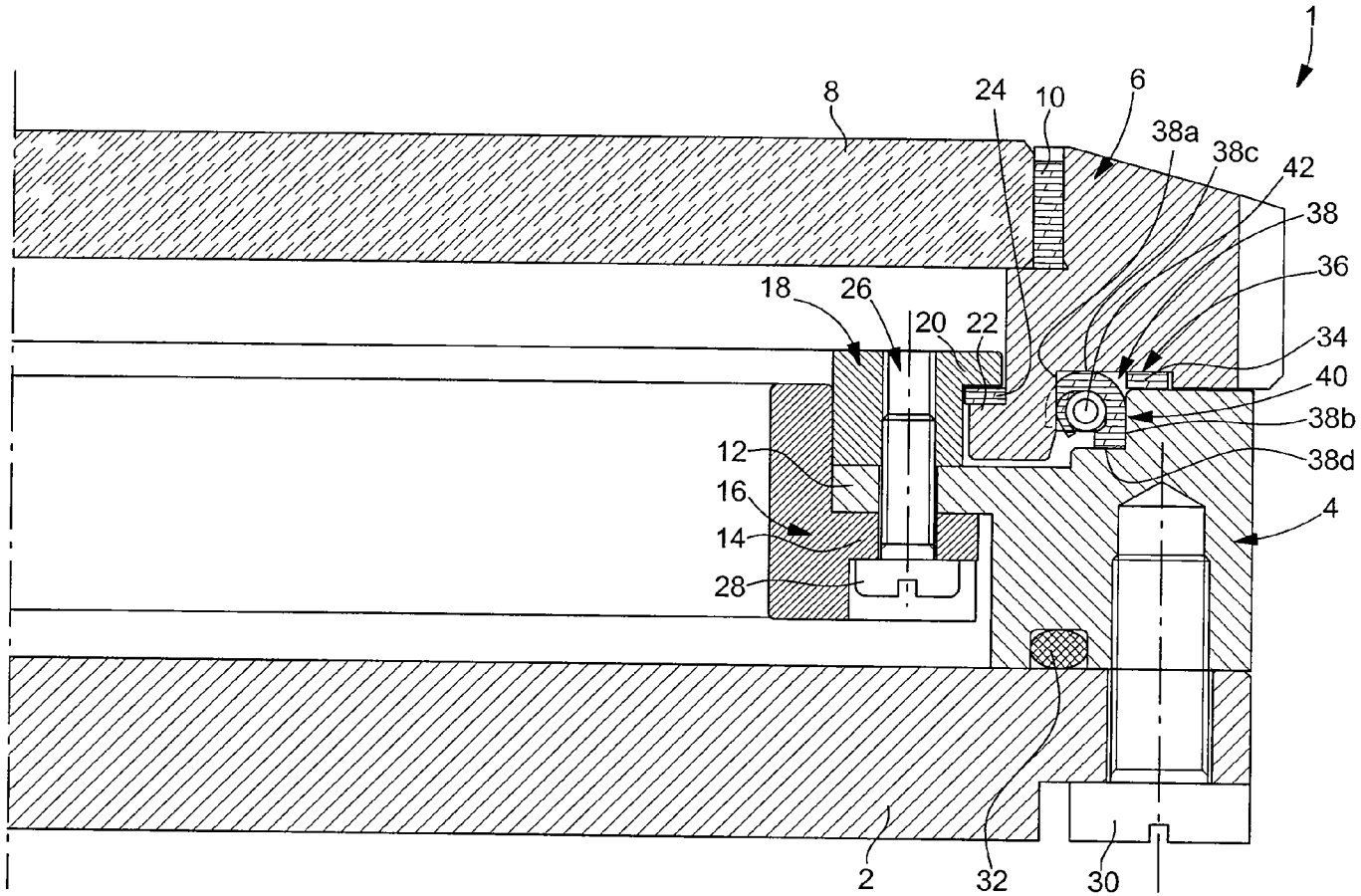
FIG. 1 is a partial cross-section of a watchcase according to the present invention.

The present invention proceeds from the general inventive idea that consists in housing, inside a sealing gasket having a predetermined cross section, a compression member having a smooth external surface, so as to prevent the contact between the compression member and the gasket from occurring only at a finite number of points, which would lead to degradation of the gasket and a loss of watertightness.

The present invention will be described in conjunction with a wristwatch case. It goes without saying that this example is given purely by way of illustration and that the present invention could apply to any type of timepiece, such as a pocket watch.

Designated as a whole by the general reference number 1, the watchcase according to the invention includes a back cover 2 and an assembly formed by a middle part 4 and a bezel 6 rotatably mounted on middle part 4. Middle part 4 and back cover 2 delimit a volume which houses the various organs of the watch (not shown in the drawing). A crystal 8 is secured to bezel 6 with the insertion of a sealing gasket 10 between crystal 8 and said bezel 6.

As FIG. 1 shows, middle part 4 has in the median part thereof a collar 12, which extends towards the centre of the case and underneath which a corresponding collar 14 slides, arranged on the external periphery of a ring 16 arranged on the inner side of middle part 4. It will be noted that in a simplified variant, ring 16 could be omitted. On the top face of collar 12 of middle part 4 there is placed a second ring 18, which has at the top end thereof an edge 20, which abuts on a shoulder 22 provided at the base of rotating bezel 6. A flat joint 24, acting as a slide block, is arranged between edge 20 of ring 18 and shoulder 22 of bezel 6. Thus, ring 18 and ring 16 sandwich collar 12, the assembly being secured by means of screws 28, only one of which is shown in the drawing, and the thread of which is made in said ring 18.

When the assembly formed by the two rings 16 and 18, middle part 4 and bezel 6 is assembled, the back cover 2 of watch 1 can be secured to middle part 4, for example by means of screws 30, only one of which is shown in the drawing. Other fastening systems are known such as a sealing gasket with no armature wire, a ball catch or screwing back cover 2 onto middle part 4 can also be envisaged. Conventionally, a sealing gasket 32 is arranged between back cover 2 and middle part 4.

A second flat joint 34 acting as a slide block is arranged in a gap 36 between rotating bezel 6 and middle part 4. This joint also seals an annular chamber 38 that communicates with gap 36 and is delimited by bezel 6 and middle part 4. This annular chamber 38 has two lateral walls 38*a* and 38*b* respectively formed by bezel 6 and middle part 4, a top wall 38*c* formed by bezel 6 and a bottom wall 38*d* essentially formed by middle part 4.

A sealing gasket 40 having a U-shaped profile is arranged in annular chamber 38 so as to make watchcase 1 according to the invention water resistant. This gasket has two lips 40*a* and 40*b* respectively abutting against walls 38*a* and 38*b* and connected to each other by an intermediate part 40*c*, which forms the base of gasket 40. As can be seen upon examining FIG. 1, the base 40*c* of gasket 40 is abutting against the top wall 38*c* of annular chamber 38. In other words, gasket 40 opens downward, opposite gap 36 through which chamber 38 communicates with the exterior. Consequently, the free lip 40*b* acts as a wedge in the event of excess water pressure, which guarantees reinforced water resistance for watchcase 1 according to the invention.

The interior of gasket 40 houses a compression member 42, such as an O-ring type joint. Compression member 42 presses lips 40*a* and 40*b* of gasket 40 respectively against the lateral walls 38*a* and 38*b* of annular chamber 38. The compression rate of sealing gasket 40 can be freely adapted by adjusting the Shore hardness or the cross-section of compression member 42. The compression rate of sealing gasket 40 also determines the rotational torque of bezel 6.

According to the invention, the external surface or covering of compression member 42 is smooth, free of any projecting elements, such that said compression member 42 is not liable to damage sealing gasket 40.

Figure 2:
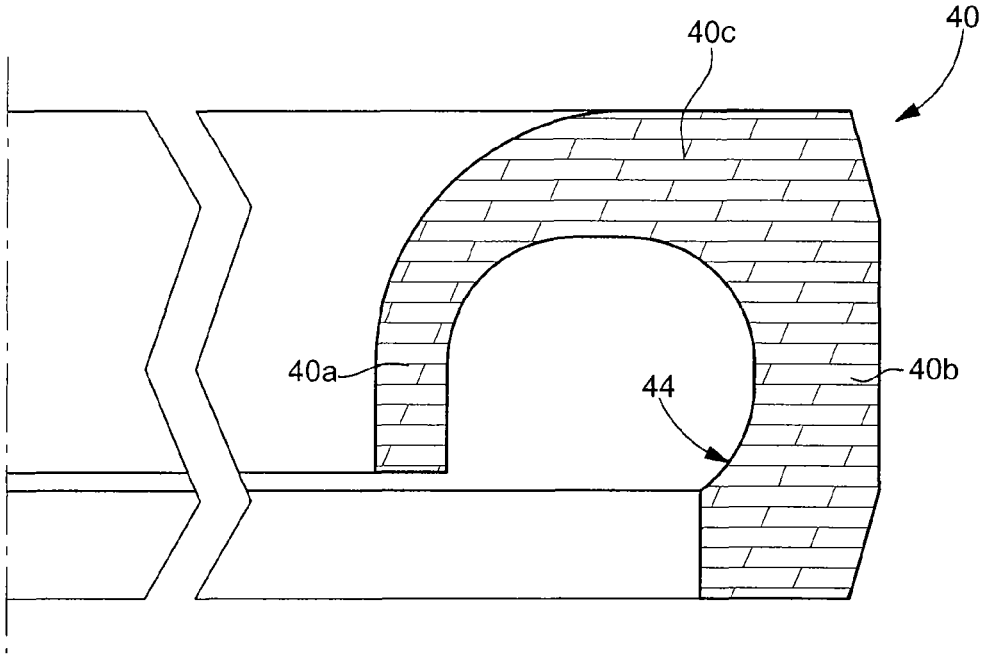
FIG. 2 is a cross-section of the sealing gasket according to the invention.
Figure 3:
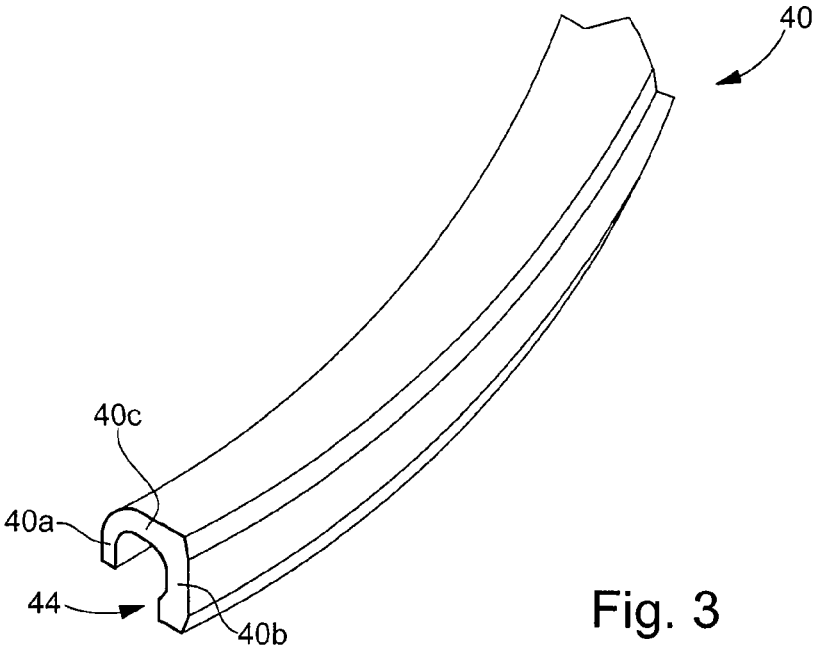
FIG. 3 is a partial perspective view of the sealing gasket according to the invention.

Sealing gasket 40 is shown schematically in cross-section and in perspective in FIGS. 2 and 3. In FIG. 1, the sealing gasket is shown in dot and dash lines in the rest position and in full lines in the compressed position in annular chamber 38. As can be seen upon examining these Figures, in the compressed position, lip 40*a* of sealing gasket 40 is partially bent underneath compression member 42. Moreover, lip 40*b* of the same gasket 40 has a return 44 at the free end thereof. Consequently, there is no risk of compression member 42 being able to fall via the effect of gravity.

The present invention is not limited to the embodiment that has just been described and various simple alterations and variants could be envisaged by those skilled in the art without departing from the scope of the invention as defined by the annexed claims. In particular, any type of compression member could be provided, provided that the external surface thereof is smooth and is not liable to damage the sealing gasket. Moreover, the sealing gasket could be made of any material with a low friction coefficient and a non-stick surface, such as polytetrafluoroethylene better known by the acronym PTFE.

The invention claimed is:

1. A timepiece including:

a rotating bezel;

a middle part, wherein the rotating bezel is able to be driven in rotation relative to the middle part; wherein the bezel and the middle part defines an annular chamber that communicates with the exterior of the timepiece via a gap, wherein the annular chamber is disposed between the bezel and the middle part;

a sealing gasket with a U-shaped profile that is arranged in the annular chamber so as to make water resistant an assembly formed by the bezel and the middle part, wherein the sealing gasket has two lips, wherein the two lips include a free lip and a second lip, wherein the free lip has a return at a free end of the free lip; and a compression member exerting a compressive effort on the two lips of the sealing gasket so that the two lips are pressed respectively against the bezel and against the middle part, wherein the compression member is housed inside the gasket, and wherein the compression member has a smooth external surface, wherein the compression member is an O-ring type joint and, in a compressed position, the second lip is partially bent underneath the compression member.

2. The timepiece according to claim 1, wherein the sealing gasket is made of polytetrafluoroethylene.

3. The timepiece according to claim 1, wherein the smooth external surface of the compression member is free of any projecting elements and free of surface unevenness.

4. A timepiece including:

(a) a rotating bezel;

(b) a middle part, wherein the rotating bezel is able to be driven in rotation relative to the middle part; wherein the bezel and the middle part defines an annular chamber that communicates with the exterior of the timepiece via a gap, wherein the annular chamber is disposed between the bezel and the middle part;

(c) a sealing gasket with a U-shaped profile that is arranged in the annular chamber so as to make water resistant an assembly formed by the bezel and the middle part, wherein the sealing gasket has two lips, and wherein a free lip of the sealing gasket has a return at a free end of the free lip; and (d) a compression member exerting a compressive effort on the two lips of the sealing gasket so that the two lips are pressed respectively against the bezel and against the middle part, wherein the compression member is housed inside the gasket, and the compression member has a smooth external surface, and wherein the two lips include the free lip and a second lip, and, in a compressed position, the second lip is partially bent underneath the compression member.

5. A timepiece including:

(a) a rotating bezel;

(b) a middle part, wherein the rotating bezel is able to be driven in rotation relative to the middle part; wherein the bezel and the middle part defines an annular chamber that communicates with the exterior of the timepiece via a gap, wherein the annular chamber is disposed between the bezel and the middle part;

(c) a sealing gasket with a U-shaped profile that is arranged in the annular chamber so as to make water resistant an assembly formed by the bezel and the middle part, wherein the sealing gasket has two lips, wherein a base of the sealing gasket forms an intermediate part connecting the two lips of the sealing gasket, and the base is located on a gap side so that one of the two lips is a free lip that has a corner effect in an event of excess water pressure, and wherein the free lip of the sealing gasket has a return at a free end of the free lip; and (d) a compression member exerting a compressive effort on the two lips of the sealing gasket so that the two lips are pressed respectively against the bezel and against the middle part, wherein the compression member is housed inside the gasket, and wherein the compression member has a smooth external surface, wherein the two lips include the free lip and a second lip, and, in a compressed position, the second lip is partially bent underneath the compression member.

6. The timepiece according to claim 5, wherein the smooth external surface of the compression member is free of any projecting elements and free of surface unevenness.

7. A timepiece including:

(a) a rotating bezel;

(b) a middle part, wherein the rotating bezel is able to be driven in rotation relative to the middle part; wherein the bezel and the middle part defines an annular chamber that communicates with the exterior of the timepiece via a gap, wherein the annular chamber is disposed between the bezel and the middle part;

(c) a sealing gasket with a U-shaped profile that is arranged in the annular chamber so as to make water resistant an assembly formed by the bezel and the middle part, wherein the sealing gasket has two lips, wherein a base of the sealing gasket forms an intermediate part connecting the two lips of the sealing gasket, and the base is located on a gap side so that one of the two lips is a free lip that has a corner effect in an event of excess water pressure, and wherein the free lip of the sealing gasket has a return at a free end of the free lip; and (d) a compression member exerting a compressive effort on the two lips of the sealing gasket so that the two lips are pressed respectively against the bezel and against the middle part, wherein the compression member is housed inside the gasket, and wherein the compression member is an O-ring type joint and has a smooth external surface, wherein the two lips include the free lip and a second lip, and, in a compressed position, the second lip is partially bent underneath the compression member.

8. The timepiece according to claim 7, wherein the smooth external surface of the compression member is free of any projecting elements and free of surface unevenness.

* * * * *